United States Patent [19]

Varga

[11] 4,010,790

[45] Mar. 8, 1977

[54] SLATTED WINDOW ASSEMBLY

[76] Inventor: John Varga, 51724 Hollyhock Road, South Bend, Ind. 46637

[22] Filed: Sept. 3, 1976

[21] Appl. No.: 720,106

[52] U.S. Cl. ..... 160/133; 160/220

[51] Int. Cl.[2] ..... E06B 9/08

[58] Field of Search ..... 160/133, 220, 113

[56] References Cited

UNITED STATES PATENTS

| | | | |
|---|---|---|---|
| 1,005,584 | 10/1911 | Trotter | 160/133 |
| 1,071,220 | 8/1913 | Elefant | 160/133 |
| 1,638,344 | 8/1927 | Kocher | 160/113 |
| 1,852,913 | 4/1932 | Bauer | 160/220 |
| 1,966,728 | 7/1934 | Lecluyse | 160/133 |

*Primary Examiner*—Peter M. Caun

*Attorney, Agent, or Firm*—Oltsch & Knoblock

[57] ABSTRACT

In a window assembly having a flexible slatted curtain in which each slat is secured to another by links. Each link is slotted and is connected to a curtain slat by being fitted over a pin carried by the slat.

3 Claims, 9 Drawing Figures

Fig. 4
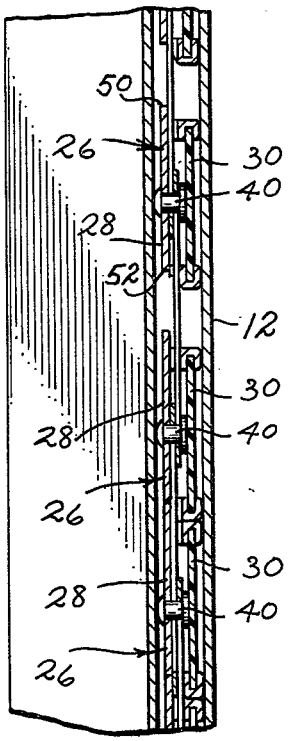
Fig. 5
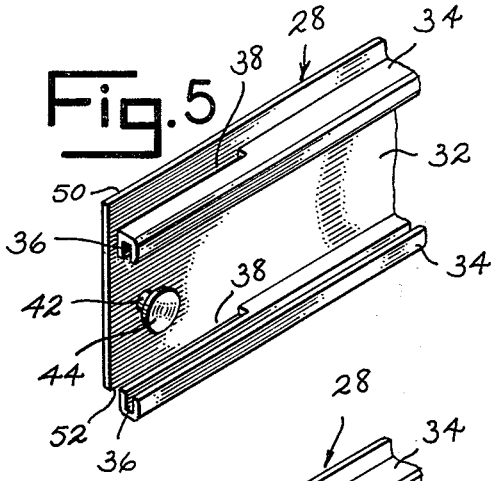
Fig. 6
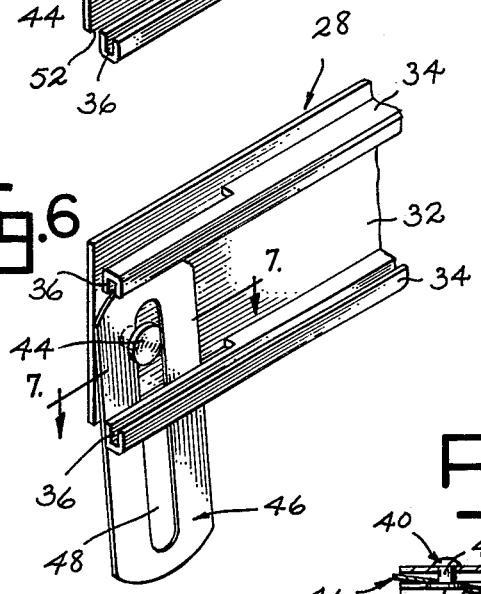
Fig. 7
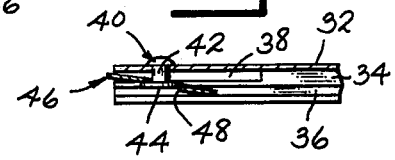
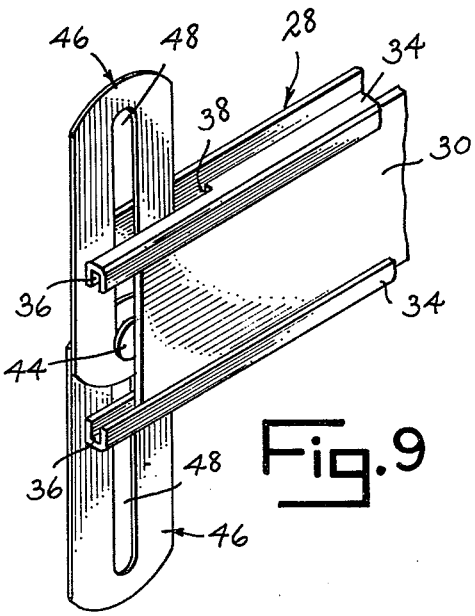
Fig. 9
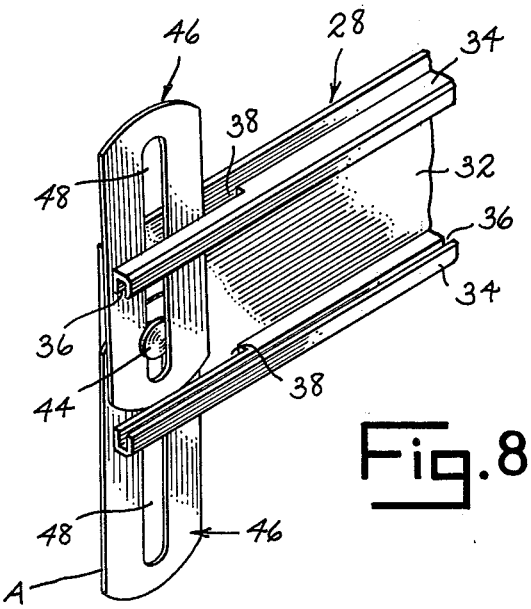
Fig. 8

SLATTED WINDOW ASSEMBLY

SUMMARY OF THE INVENTION

This invention relates to a window assembly having an improved flexible slatted curtain.

The curtain of the window assembly includes a plurality of slats located side by side. Each slat has a channel part and an overlying cover. The channel part of each slat carries a pin at each of its opposite end portions and is slotted to allow a link, which has a longitudinal slot formed therein, to be inserted into the slot and fitted over the pin at each channel part end portion. Each adjacent pair of slats is accordingly connected by a pair of links at corresponding end portions of the channel parts. The cover of each slat is fitted into cooperating grooves within each channel part and overlies the pins and connected links. The links are designed so as to be simply and easily disconnected from the channel parts upon exposure by removal of the overlying covers.

Accordingly, it is an object of this invention to provide a window assembly having a slatted curtain of improved construction.

Another object of this invention is to provide a curtain for a window assembly having slats which are connected by removable links.

Other objects of this invention will become apparent upon a reading of the invention's description.

BRIEF DESCRIPTION OF THE DRAWINGS

A preferred embodiment of this invention has been chosen for purposes of illustration and description wherein:

FIG. 4 is a sectional view of the curtain taken along line 4—4 of FIG. 3.

FIG. 5 is a fragmentary end view of the channel part of a curtain slot.

FIG. 6 is a view of the channel part of FIG. 5 having one connecting link being attached.

FIG. 7 is a sectional view taken along line 7—7 of FIG. 6.

FIG. 8 is a view of the channel part of FIG. 5 having a second connecting link being attached.

FIG. 9 is a view of the channel part of FIG. 5 having both connecting links attached and its cover being applied.

DESCRIPTION OF THE PREFERRED EMBODIMENT

The preferred embodiment illustrated is not intended to be exhaustive or to limit the invention to the precise form disclosed. It has been chosen and described in order to best explain the invention and its application and practical use to thereby enable others skilled in the art to best utilize the invention.

Figure 1:
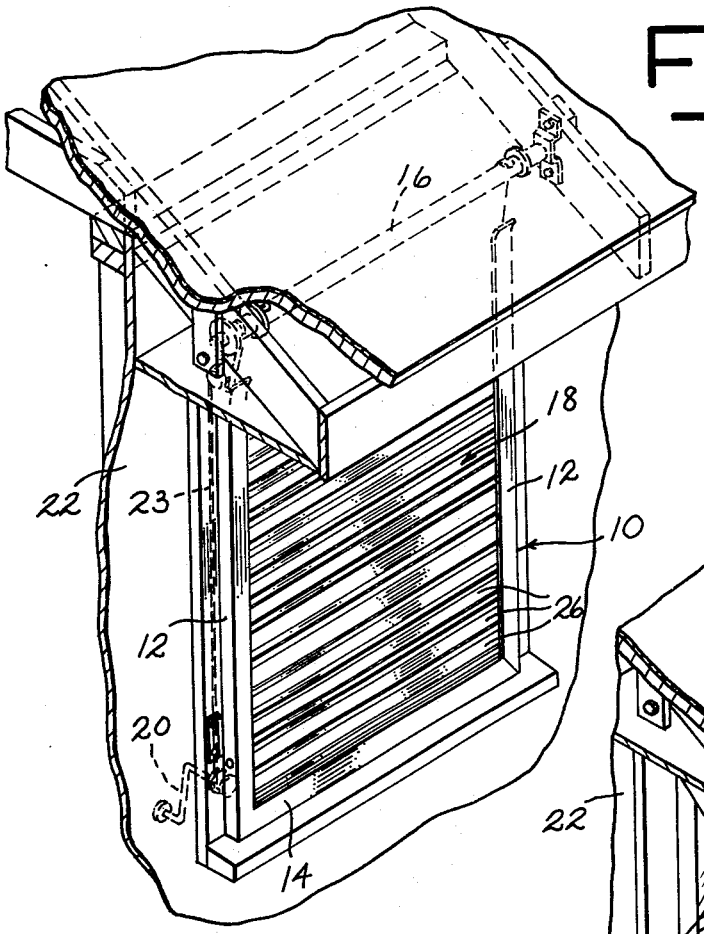
FIG. 1 is a perspective view of a window assembly utilizing the slatted curtain of this invention with the curtain lowered and closed.
Figure 2:
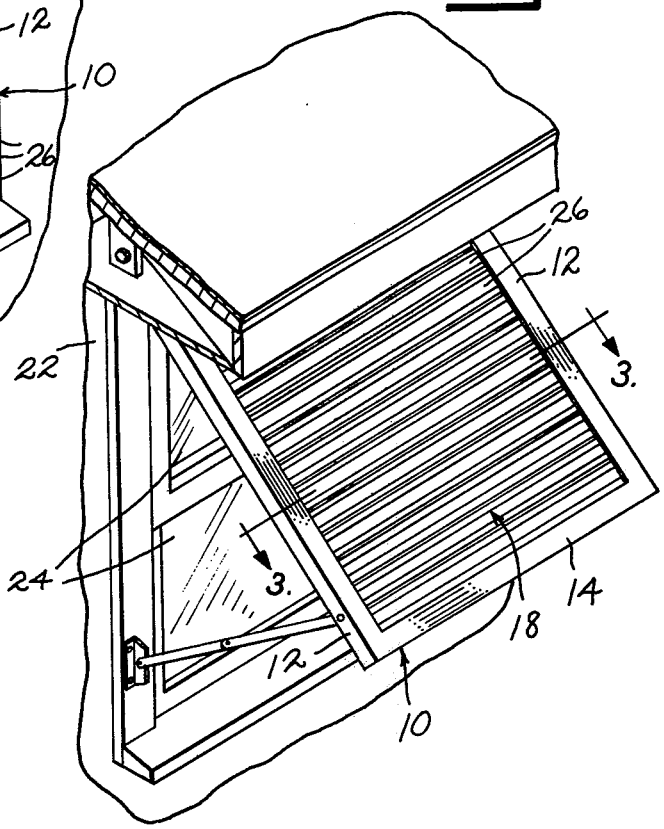
FIG. 2 is a perspective view of the window assembly with the curtain lowered but open.
Figure 3:
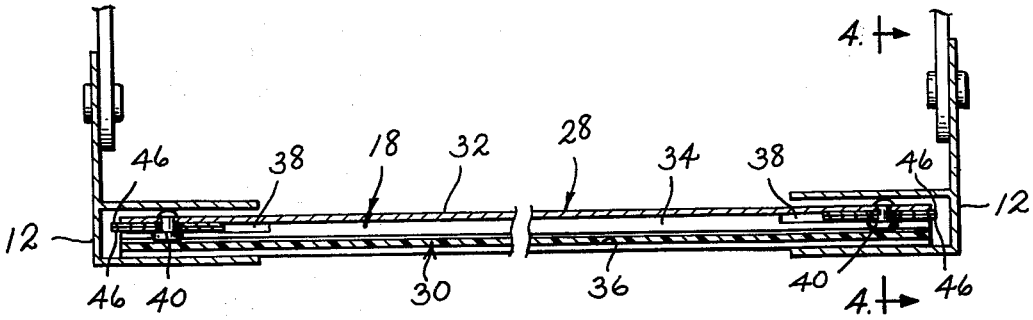
FIG. 3 is a sectional view of the curtain taken along line 3—3 of FIG. 2.

The window assembly shown as the illustrated embodiment includes a frame having sides 12 and a base 14. Frame 10, which may be of a light weight metal or wooden construction, is pivotally connected at its top to building structure 22. A reel 16 is mounted above frame 10. A flexible slatted curtain 18 is carried within frame 10 and connected at its upper end to reel 16. An actuator member, such as hand crank 20, is mounted within the interior of the building structure 22. A cable 23 extends between crank 20 and reel 16 in such a manner that upon rotation of the crank reel 16 will be turned to cause curtain 18 to be wound upon or unwound from the reel. This causes the raising and lowering of curtain 18 within frame 10. Additionally, by being pivotally connected to building structure 22, frame 10 can be pivoted from the position shown in FIG. 1 overlying windows 24 to the position shown in FIG. 2 exposing the windows. As thus far described, the window assembly is of known construction and may be of the type depicted in U.S. Pat. Nos. 1,071,220; 1,638,344 and 2,361,762.

The invention of the aforedescribed window assembly lies in the manner in which slats 26 of curtain 18 are connected. Slats 26 are positioned side by side with each slat including a channel part 28 which is preferably formed of a light weight metallic material, such as aluminum, and a cover 30 which may be formed of a generally rigid plastic sheet material.

Each channel part 28 includes a base 32 and parallel sides 34. Each side 34 is formed so as to define an elongated groove 36. Grooves 36 in sides 34 are opposed and extended the length of the channel part. A slotted opening 38 is formed in each side 34 at the ends of the channel part. Each slotted opening 38 extends inwardly from the end of the channel part between base 32 and groove 36 in the side. A pin 40 having a neck 42 and enlarged flat head 44 is carried by base 32 of each channel part 18 near each end of the channel part and approximately midway between slotted openings 38. Head 44 of each pin 40 extends approximately to the lower level of grooves 36 in the channel part sides 34.

Each slat 26 is connected by a pair of links 46 to the next adjacent slat. Each link 46 is formed from a thin flat spring material and has a longitudinal slot 48 formed in it which extends from one end portion to the other of the link. Slot 48 in each link 46 has a width which is less than the diameter of head 44 but which slightly exceeds the distance between one side of neck 40 and the opposite side of head 44 of each pin 40. This enables each link 46 when inserted endwise through a slotted opening 38 in a channel part 28 to be fitted over the adjacent pin 40 as illustrated in FIGS. 6 and 7. The relative thinness of each link 46 in comparison to the width of slotted openings 38 allows the link to be flexed upwardly over the head 44 of the pin 40 to secure the link to the channel part 28. Once each link 46 is connected to a channel part 28, it is adjusted until the pin 40 is located at one end of its slot 48 and its free end protrudes laterally of the channel part through a slotted opening 38. This protruding end, designated by the letter "A" in FIG. 8, is inserted through the correspondingly positioned slotted opening 38 of the next adjacent channel part 28 and fitted over pin head 44 of that channel part in the same manner as the link was previously attached to the first connected channel part.

Each channel part 28 is connected at each end by a link 46 to an adjacent channel part. With the exception of those slats 26 at the ends of curtain 18, each end of the channel parts 28 of the other slats will carry a pair of links 46 as seen in FIG. 9. Because of enlarged heads 44 of pins 40, it is not envisioned that connected links 46 would become disengaged from the pins during use of curtain 18. Nevertheless, by inserting a cover 30, which is preferably of a pleasing decor color, into opposing grooves 36 of each channel part 28 to overlie pins 40, an interlock between links 46 and the accommodating pins is assured. Each slat 26 can be diassembled and removed for cleaning, repairing or replacement in reverse order from the manner in which the links 46 were assembled to the channel parts 28 and the cover 30 applied. During the raising and lowering of curtain 18 within frame 10, links 46 will flex as the slats 26 are wound about reel 16.

Side 52 of base 32 of each channel part 28 is inset from connected side 34 while side 50 of the base is outset from its connected side 34 so as to provide an interfitting overlap between slats 26 as the slats bottom within frame 10 (see FIG. 4). Links 46 are sufficiently long enough to accommodate relative movement between adjacent slats 26 so as to allow the overlapped side 52 of the base of the upper slat to be shifted upwardly and away from the upper side 50 of the base of the lower adjacent slat as the curtain is raised. This allows one slat to shift angularly relative to the other by bending of interconnecting links 46 as the slats are rolled upon reel 16.

It is to be understood that the invention should not be limited to the details above given but may be modified within the scope of the appended claims.

What I claim is:

1. In a window assembly having a frame and a flexible slatted curtain carried by said frame between spaced guide means, a winding device, one end of said curtain connected to said winding device, means for rotating said winding device to cause said curtain to be wound about and unwound from the winding device in shifting between raised and loweed positions, the improvement wherein said curtain includes a plurality of slats located side by side, each slat including a channel part and a cover, each channel part including a base having end portions and spaced sides projecting from said base, said sides defining opposed groove means extending between said base end portions, a pin carried by said base at each end portion thereof, each pin projecting outwardly from said base and terminating adjacent the level of said opposed groove means, a slotted opening formed in each side at each base end portion between said base and the groove means of the side, a plurality of links each having a longitudinal slot formed therein extending from one end portion to the other end portion of the link, a said link located at corresponding base end portions of adjacent channel parts and having one of its end portions fitted through a said slotted opening in one adjacent channel part with the pin thereof extending lockingly through said slot in the link and having its other end portion fitted through a said slotted opening in the other adjacent channel part with the pin thereof extending lockingly through said slot in the link, a said cover fitted between the sides of each channel part within said groove means of the channel part and overlying each pin of the channel part and locked link end portions.

2. The window assembly of claim 1 wherein a link extends through each slotted opening of each channel part that lies between other channel parts of said curtain and lockingly engages a said pin of such channel part.

3. The window assembly of claim 2 wherein each channel part pin includes a neck and terminates in an enlarged flattened head having a transverse dimension exceeding the width of each link slot, the width of each pin as measured from one side of its neck to the opposite side of its head being less than the width of each link slot to permit such link to be inserted over the head of said pin.

* * * * *